US008212188B2

(12) United States Patent
Kim et al.

(10) Patent No.: US 8,212,188 B2
(45) Date of Patent: Jul. 3, 2012

(54) COOKING APPARATUS AND METHOD OF CONTROLLING THE SAME

(75) Inventors: Tae Woo Kim, Busan (KR); Seok Weon Hong, Yongin-si (KR); Jong Chull Shon, Suwon-si (KR); Hyang Ki Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1066 days.

(21) Appl. No.: 12/155,313

(22) Filed: Jun. 2, 2008

(65) Prior Publication Data

US 2009/0032521 A1 Feb. 5, 2009

(30) Foreign Application Priority Data

Jul. 31, 2007 (KR) ..... 10-2007-0076993

(51) Int. Cl.
*A21B 1/00* (2006.01)
*F24C 15/32* (2006.01)

(52) U.S. Cl. ..... 219/400; 219/392; 219/394; 219/385; 126/21 A

(58) Field of Classification Search ..... 219/400, 219/392, 394, 385; 126/21 A
See application file for complete search history.

(56) References Cited

U.S. PATENT DOCUMENTS 7,442,901 B2 * 10/2008 Kim et al. ..... 219/394

FOREIGN PATENT DOCUMENTS

| | | |
|---|---|---|
| DE | 102004046437 | 4/2006 |
| EP | 0641976 | 3/1995 |
| EP | 1748255 | 1/2007 |
| KR | 10-2005-0079522 | 8/2005 |
| KR | 10-2006-0044217 | 5/2006 |
| WO | 2008/148846 | 12/2008 |

OTHER PUBLICATIONS

European Search Report mailed Jun. 3, 2009, in corresponding European Patent Application No. 08157482.4 (6 pp.).
Office Action issued by the Korean Patent Office on Jan. 16, 2012 in the related Korean patent application.

* cited by examiner

*Primary Examiner* — Shawntina Fuqua
(74) *Attorney, Agent, or Firm* — Staas & Halsey LLP

(57) ABSTRACT

A cooking apparatus and a method selectably cook food using one or more of a plurality of cooking spaces formed by a divider while using a same heat source and control different temperatures of the cooking spaces formed by the divider. An embodiment of the cooking apparatus includes a cooking chamber, a divider to divide the cooking chamber into cooking spaces, a heated air supply unit including a fan cover having upper and lower ventilation holes, a detection unit including temperature sensors to detect the interior temperatures of the cooking spaces, an airflow adjusting unit to adjust an amount of heated air supplied, and a control unit to control the amount of heated air, based on an interior temperature of the cooking space, to adjust a temperature to a target temperature set by a user.

20 Claims, 13 Drawing Sheets

COOKING APPARATUS AND METHOD OF CONTROLLING THE SAME

CROSS-REFERENCE TO RELATED APPLICATIONS

This application claims the benefit of Korean Patent Application No. 2007-76993, filed on Jul. 31, 2007 in the Korean Intellectual Property Office, the disclosure of which is incorporated herein by reference.

BACKGROUND

1. Field

The present invention relates to a cooking apparatus, and, more particularly, to a cooking apparatus that cooks food using a blowing fan.

2. Description of the Related Art

Generally, a conventional convection type cooking apparatus includes a heater energized to emit heat, an oven cavity in which food is cooked by heat emitted from the heater, a blowing fan mounted in the oven cavity to circulate air in the oven cavity by convection, convection inlet holes mounted at the rear of the cavity to suction the air circulated by the rotation of the blowing fan, convection outlet holes mounted at the rear of the cavity to discharge the air circulated by the rotation of the blowing fan, and a plurality of trays mounted in the oven cavity for allowing food to be placed thereon, When a user puts food in the oven cavity and inputs a cooking command, the blowing fan is driven to suction air from the oven cavity, the suctioned air is heated by the heater, and the heated air is discharged into the oven cavity. In this way, air is forcibly circulated in the conventional cooking apparatus. During the circulation of the air, the food is in continuous contact with high-temperature air, with the result that heat is transmitted to the food, and therefore, the food is cooked by the heat.

However, the conventional cooking apparatus has a single oven cavity. As a result, even when it is necessary to cook a small amount of food, the entire oven cavity is heated. Consequently, the cooking time and power consumption are increased.

To solve the problem, Korean Patent Application Publication No. 10-2006-44217 discloses an electric oven constructed in a structure in which a cooking chamber is divided into upper and lower cooking chambers by a partition, such that the upper and lower cooking chambers are selectively used, thereby reducing the cooking time and power consumption.

Specifically, the disclosed electric oven includes an oven body having a cooking chamber defined therein, a door to open and close the cooking chamber, a heater unit mounted in the oven body to heat the cooking chamber, a partition detachably mounted in the cooking chamber to divide the cooking chamber into a first cooking chamber and a second cooking chamber, a mode selection unit to select a single cooking mode in which food is cooked in the cooking chamber while the partition is separated from the cooking chamber and a double cooking mode in which food is cooked in the cooking chamber while the partition is mounted in the cooking chamber, and a control unit to control the mode selection unit to select the single cooking mode or the double cooking mode based on a determination as to whether the partition is mounted in, or separated from, the cooking chamber.

However, the oven is constructed in a structure in which the cooking chambers are selectively heated. Consequently, it is necessary to mount a heater and a blowing fan in each of the first and second cooking chambers, divided by the partition. Furthermore, it is required that the mode selection unit be divided into mode selection units corresponding to the single cooking mode and the double cooking mode. As a result, the structure and control of the oven are complicated, and the manufacturing costs of the oven are increased.

According to the conventional art disclosed in the publication, the temperature of the cooking chamber is controlled by the on/off operation of the blowing fan or the on/off operation of the heater. Specifically, the on/off operation of the blowing fan or the on/off operation of the heater must be repeatedly performed to control the temperature of the cooking chamber. Consequently, the temperature in the cooking chamber greatly fluctuates, with the result that the cooking efficiency is lowered when cooking food necessary to be maintained at a fixed temperature.

SUMMARY

Therefore, it is an aspect of the invention to provide a cooking apparatus to cook food using only one of cooking spaces divided by a divider while using the same heat source and a method of controlling the same.

It is another aspect of the invention to provide a cooking apparatus to control a plurality of cooking spaces divided by a divider at different temperatures, while using the same heat source, through a relatively non-complex mechanical structure and a method of controlling the same.

It is another aspect of the invention to provide a cooking apparatus to reduce the temperature change in a cooking chamber and a method of controlling the same.

It is a further aspect of the invention to provide a cooking apparatus to control the opening degree of ventilation holes to adjust the flow of air supplied into a cooking chamber and a method of controlling the same.

In accordance with one aspect, the present invention provides a cooking apparatus including a cooking chamber, a heated air supply unit to supply heated air into the cooking chamber, and a divider to divide the cooking chamber into cooking spaces, wherein the cooking apparatus further includes an airflow adjusting unit to adjust the amount of heated air supplied to any one of the cooking spaces from the heated air supply unit.

Generally, the heated air supply unit includes a fan cover having ventilation holes, and the airflow adjusting unit controls the opening degree of the ventilation holes formed at the fan cover to adjust the amount of heated air supplied into the cooking space.

Typically, the airflow adjusting unit includes an opening and closing cover having ventilation holes corresponding to the ventilation holes of the fan cover, the opening and closing cover being vertically movably mounted at the front of the fan cover, a drive motor to provide a driving force necessary to vertically move the opening and closing cover, and a connection member to transmit the driving force from the drive motor to the opening and closing cover.

Generally, the connection member includes a body coupled to a rotary shaft of the drive motor on the same axis and an eccentric shaft protruding from the front of the body, and the opening and closing cover is provided at the lower end thereof with an interlocking part having a rectangular groove, in which the eccentric shaft of the connection member is fitted.

Typically, the drive motor is a motor that rotates in one direction or a motor that rotates in forward and reverse directions, the airflow adjusting unit further includes a switch that is turned on/off to detect the maximum height or the minimum height of the opening and closing cover, and the connection member is provided at the rear of the body thereof with a cam to turn the switch on/off with the rotation of the drive motor.

Alternatively, the drive motor may be a step motor. In this case, the switch or the cam is not necessary.

Generally, the opening and closing cover is provided at the rear thereof with hooks, and the fan cover has grooves to receive the hooks.

Typically, the fan cover and the opening and closing cover protrude from the rear of the cooking chamber, and the ventilation holes include inlet holes formed at the central front of the fan cover and outlet holes formed at the edge of the fan cover.

Generally, the divider has an insertion groove to surround the fan cover and the opening and closing cover.

In accordance with another aspect, the present invention provides a cooking apparatus including a cooking chamber, a divider to divide the cooking chamber into cooking spaces, a heated air supply unit including a fan cover having upper and lower ventilation holes, a detection unit including temperature sensors to detect the interior temperatures of the cooking spaces, an airflow adjusting unit to adjust the amount of heated air supplied to any one of the cooking spaces from the heated air supply unit, and a control unit to control the amount of heated air supplied into the cooking space through the airflow adjusting unit, based on the interior temperature of the cooking space detected by the detection unit, such that the detected temperature coincides with the target temperature set by a user.

Typically, the airflow adjusting unit controls the opening degree of the upper ventilation holes or the lower ventilation holes formed at the fan cover to adjust the amount of heated air supplied into the cooking space.

Generally, when the target temperature of any one of the cooking spaces is not set by the user, the control unit controls the airflow adjusting unit to close the ventilation holes, through which heated air is supplied into the cooking space.

In accordance with another aspect, the present invention provides a method of controlling a cooking apparatus including first and second cooking chambers divided by a divider, a heated air supply unit including a fan cover having ventilation holes, and an airflow adjusting unit to adjust the amount of heated air supplied into the second cooking chamber, the method including determining whether target temperatures of the first and second cooking chambers have been set, when it is determined that the target temperatures of the first and second cooking chambers have been set, operating the heated air supply unit and the airflow adjusting unit to control the opening degree of the ventilation holes communicating with the second cooking chamber such that the temperature of the second cooking chamber coincides with the target temperature of the second cooking chamber, and performing a cooking operation in the first and second cooking chambers.

Generally, the method further includes determining whether the temperature of the second cooking chamber has reached the target temperature, when the temperature of the second cooking chamber is higher, by a predetermined level, than the target temperature, controlling the airflow adjusting unit to decrease the opening degree of the ventilation holes communicating with the second cooking chamber, and, when the temperature of the second cooking chamber is lower, by the predetermined level, than the target temperature, controlling the airflow adjusting unit to increase the opening degree of the ventilation holes communicating with the second cooking chamber.

Typically, the method further includes determining whether the cooking operation in the second cooking chamber has been completed, and, when the cooking operation has been completed, controlling the airflow adjusting unit to close the ventilation holes communicating with the second cooking chamber and continuously performing the cooking operation in the first cooking chamber.

Generally, the method further includes, when only the target temperature of the first cooking chamber is set, operating the heated air supply unit and the airflow adjusting unit to close the ventilation holes communicating with the second cooking chamber, and performing only the cooking operation in the first cooking chamber.

In accordance with a further aspect, the present invention provides a method of controlling a cooking apparatus including first and second cooking chambers divided by a divider, a heated air supply unit including a fan cover having ventilation holes, and an airflow adjusting unit to adjust the amount of heated air supplied into the second cooking chamber, the method including determining whether target temperatures of the first and second cooking chambers have been set, when it is determined that the target temperatures of the first and second cooking chambers have been set, operating the heated air supply unit and the airflow adjusting unit to completely open the ventilation holes communicating with the second cooking chamber, performing a cooking operation in the first and second cooking chambers, and, when the temperature of the second cooking chamber has reached the target temperature, operating the airflow adjusting unit to control the opening degree of the ventilation holes communicating with the second cooking chamber.

Typically, the method further includes determining whether the cooking operation in the second cooking chamber has been completed, and, when the cooking operation has been completed, controlling the airflow adjusting unit to close the ventilation holes communicating with the second cooking chamber and continuously performing the cooking operation in the first cooking chamber.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
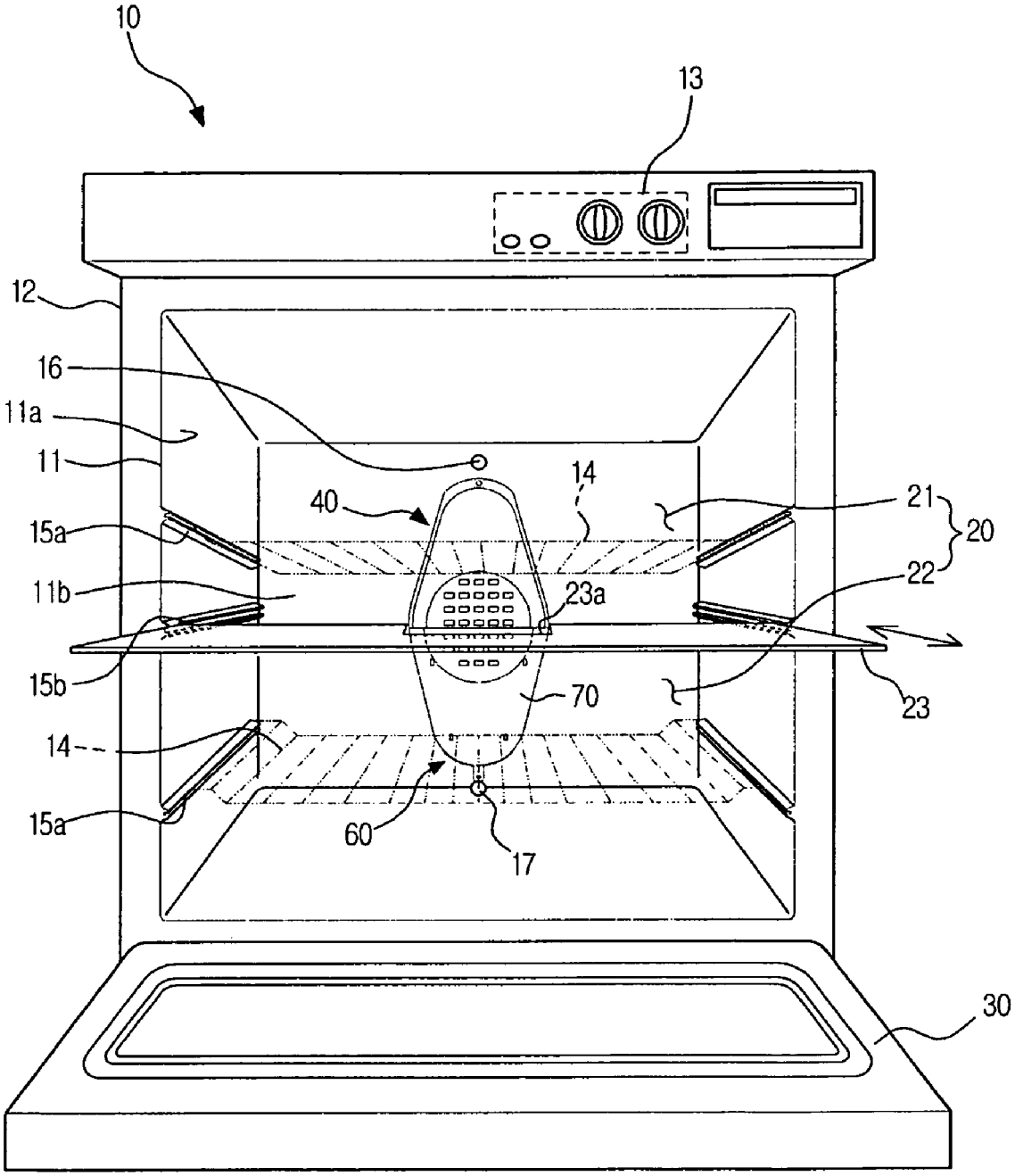
FIG. 1 is a perspective view schematically illustrating the structure of a cooking apparatus according to an embodiment of the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

FIG. 1 is a perspective view schematically illustrating the structure of a cooking apparatus according to an embodiment of the present invention.

As shown in FIG. 1, the cooking apparatus includes a main body 10 open at the front thereof and having a cooking chamber 20 defined therein, a door 30 hingedly mounted to the front of the main body 10 to open and close the cooking chamber 20, a divider 23 detachably mounted in the cooking chamber 20 to divide the cooking chamber 20 into a plurality of cooking spaces, a heated air supply unit 40 to supply heated air into the cooking chamber 20, and an airflow adjusting unit 60 to adjust the flow of heated air supplied to the heated air supply unit 40 to control the temperature in some of the cooking spaces of the cooking chamber 20 divided by the divider 23.

The main body 10 includes an inner case 11 defining the cooking chamber 20, an outer case 12 defining the external appearance of the cooking apparatus, and a control panel 13 mounted at the top of the outer case 12 to allow a user to input cooking kind, cooking time, and cooking temperature.

The inner case 11 defines the cooking chamber 20, which is opened and closed by the door 30, which is hingedly mounted to the front of the main body 10. The inner case 11 is provided at each side 11*a* thereof with a plurality of guides 15*a* and 15*b* to guide the attachment and detachment of trays 14 on which food is placed. Among the guides 15*a* and 15*b*, the middle guide 15*b* serves to guide the attachment and detachment of the divider 23, which divides the cooking chamber 20 into upper and lower cooking chambers, as well as the corresponding tray 14.

Consequently, when the divider 23 is mounted in the cooking chamber 20 along the middle guides 15*b*, the cooking chamber 20 is divided into a first cooking chamber 21, which is the upper part of the cooking chamber 20, and a second cooking chamber 22, which is the lower part of the cooking chamber 20.

The divider 23 is formed approximately in the shape of a rectangle. The divider 23 has an insertion groove 23*a*, which surrounds the heated air supply unit 40 such that the flow of air between the first and second cooking chambers 21 and 22 is minimized when the divider 23 is mounted in the cooking chamber 20. Also, the divider 23 contains an insulation material to prevent heat transfer between the first and second cooking chambers 21 and 22.

At the rear 11*b* of the inner case 11 are mounted temperature sensors 16 and 17 to measure the temperature of the cooking chamber 20. The temperature sensors 16 and 17 include a first temperature sensor 16 mounted to the upper part of the rear 11*b* of the inner case 11 to measure the temperature of the first cooking chamber 21, when the divider 23 is mounted in the cooking chamber 20, and to measure the temperature of the cooking chamber 20, when the divider 23 is not mounted in the cooking chamber 20, and a second temperature sensor 17 mounted to the lower part of the rear 11*b* of the inner case 11 to measure the temperature of the second cooking chamber 22, when the divider 23 is mounted in the cooking chamber 20. Of course, it is possible to measure the temperature of the cooking chamber 20 using the second temperature sensor 17, when the divider 23 is not mounted in the cooking chamber 20.

The heated air supply unit 40 is mounted at the middle of the rear 11*b* of the inner case 11 to supply heated air into the cooking chamber 20.

Figure 2:
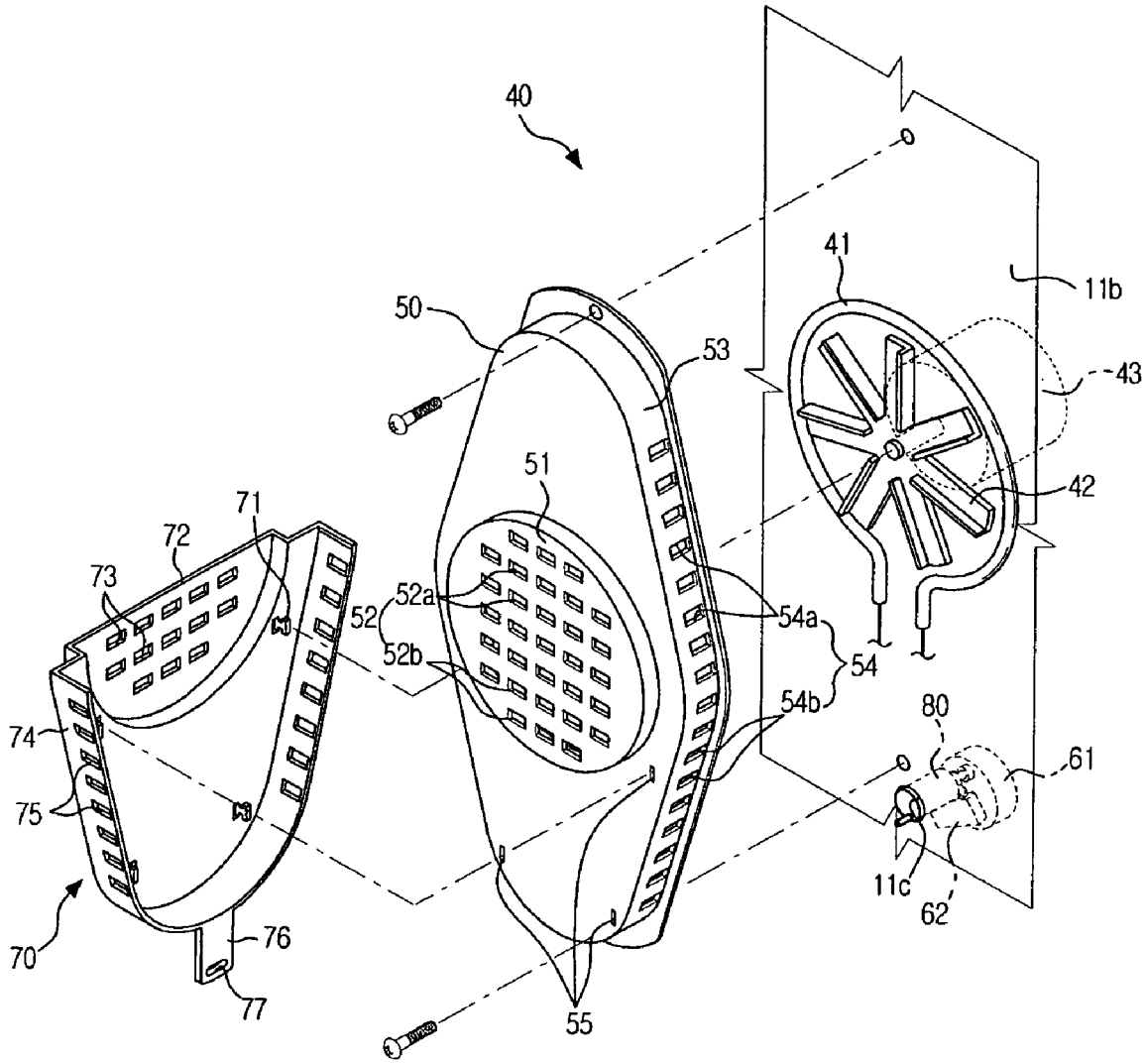
FIG. 2 is an exploded perspective view illustrating a heated air supply unit and an airflow adjusting unit of the cooking apparatus according to an embodiment of the present invention.
Figure 3:
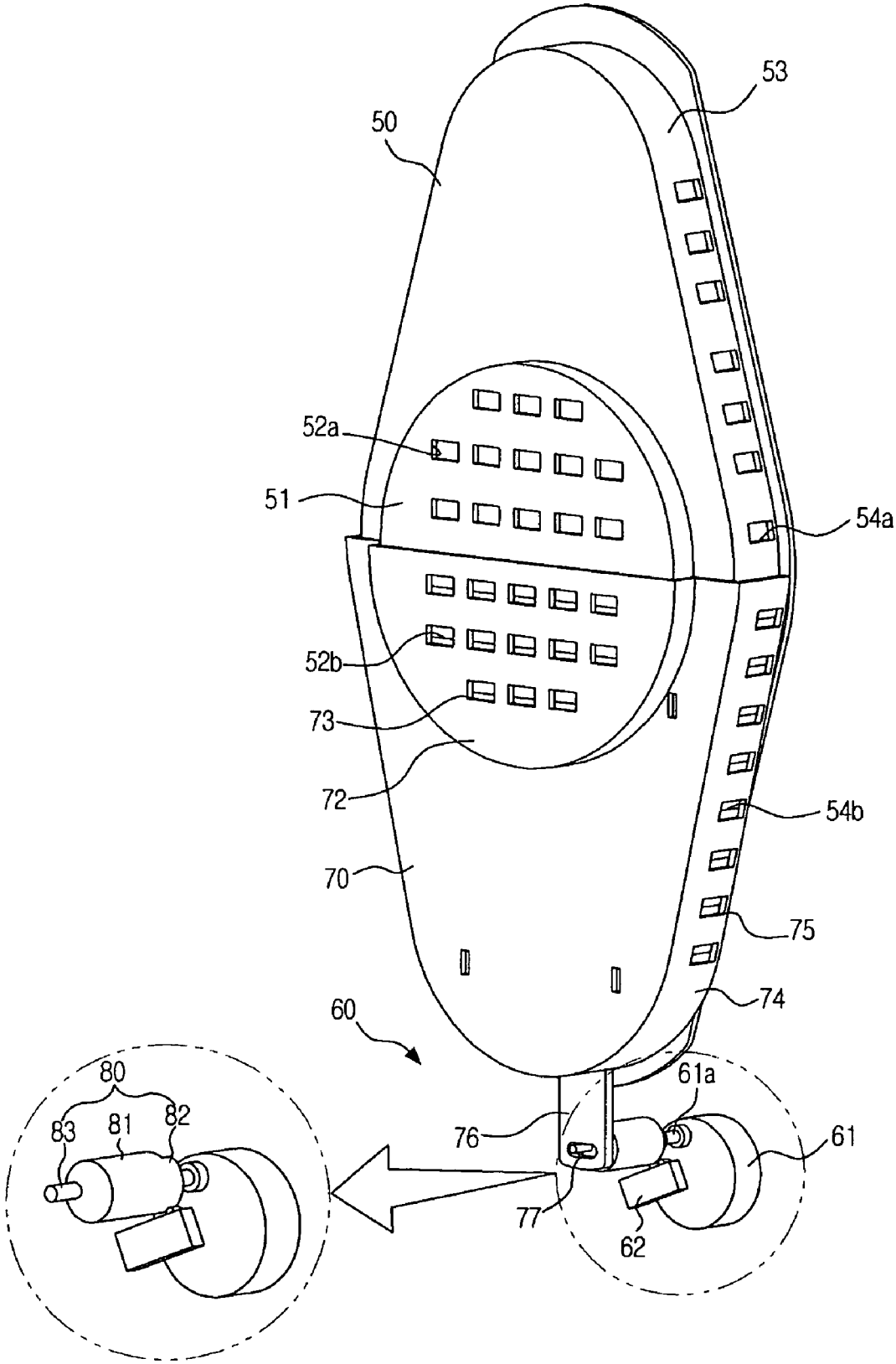
FIG. 3 is a perspective view illustrating the coupling between the heated air supply unit and the airflow adjusting unit of FIG. 2.

FIG. 2 is an exploded perspective view illustrating the heated air supply unit and the airflow adjusting unit of the cooking apparatus according to an embodiment of the present invention, FIG. 3 is a perspective view illustrating the coupling between the heated air supply unit and the airflow adjusting unit of FIG. 2, and FIGS. 4 to 6 are views illustrating the operation of the heated air supply unit and the airflow adjusting unit of the cooking apparatus according to embodiments of the present invention.

As shown in FIG. 2, the heated air supply unit 40 includes a heater 41, a blowing fan 42 mounted in the heater 41 to forcibly supply air, heated by the heater 41, into the cooking chamber 20, and a fan cover 50, having inlet holes 52 (52*a*, 52*b*) and outlet holes 54 (54*a*, 54*b*), to cover the blowing fan 42.

The heater 41 is mounted at the center of the rear of the cooking chamber 20 to heat air introduced into the fan cover 50 by the blowing fan 42. In this embodiment, the heater 41 is formed in a ring shape, although the heater 41 may be formed in various shapes.

The blowing fan 42 forcibly circulates air in the cooking chamber 20 to accelerate heat transfer. Specifically, the blowing fan 42 supplies heated air to food received in the cooking chamber 20 to accelerate heat transfer. In this embodiment, the blowing fan 42 is a centrifugal fan, although alternatively, the blowing fan 42 may be an axial flow fan. The blowing fan 42 is operated simultaneously with the driving of the heater 41. According to circumstances, however, the blowing fan 42 may be operated independently even when the heater 41 is not driven. To the rear of the blowing fan 42 is mounted a fan motor 43 to drive the blowing fan 42.

The fan cover 50 is located in front of the blowing fan 42 and the heater 41 to cover the blowing fan 42 and the heater 41.

The fan cover 50 is formed approximately in the shape of an oval having a vertical length greater than a lateral length. The fan cover 50 protrudes forward from the rear of the cooking chamber 20. Air, forcibly blown by the blowing fan 42, is suctioned and discharged through the inlet holes 52 (52*a*, 52*b*) and the outlet holes 54 (54*a*, 54*b*) of the fan cover 50, respectively. Of course, the fan cover 50 may be formed in various shapes, such as a circle or a polygon, having a size sufficient to cover the blowing fan 42 and the heater 41.

The inlet holes 52 (52*a*, 52*b*) are formed at the central front 51 of the fan cover 50 corresponding to the front of the blowing fan 42 to suction air from the cooking chamber 20. The inlet holes 52 (52*a*, 52*b*) include upper inlet holes 52*a*, formed at the upper part of the fan cover 52, and lower inlet holes 52*b*, formed at the lower part of the fan cover 52.

The outlet holes 54 (54*a*, 54*b*) are formed at the side edge 53 of the fan cover 50 corresponding to the side of the blowing fan 42 to discharge air, heated by the heater 41, into the cooking chamber 20. The outlet holes 54 (54*a*, 54*b*) include upper outlet holes 54*a*, formed at the upper part of the fan cover 52, and lower outlet holes 54*b*, formed at the lower part of the fan cover 52.

The lower inlet holes 52*b* and the lower outlet holes 54*b*, formed at the lower part of the fan cover 52, constitute lower ventilation holes 52*b* and 54*b*, and upper inlet holes 52*a* and the upper outlet holes 54*a*, formed at the upper part of the fan cover 52, constitute upper ventilation holes 52*a* and 54*a*.

The airflow adjusting unit 60 (see FIG. 1) of the cooking apparatus controls the opening degree of the lower ventilation holes 52*b* and 54*b* of the fan cover 50 to adjust the temperature of the second cooking chamber 22, partitioned from the first cooking chamber 21 by the divider 23. Specifically, the airflow adjusting unit 60 adjusts the flow of heated air discharged into the second cooking chamber 22 through the lower outlet holes 54*b* to control the temperature of the second cooking chamber 22.

As shown in FIGS. 2 and 3, the airflow adjusting unit 60 includes an opening and closing cover 70 movably mounted at the lower front of the fan cover 50, a drive motor 61 to provide a driving force necessary to vertically move the opening and closing cover 70, a connection member 80 to transmit the driving force from the drive motor 51 to the opening and closing cover 70, and a switch 62 constructed to be turned on/off by the rotation of the connection member 80.

A plurality of grooves 55 are formed at the front of the fan cover 50 such that the opening and closing cover 70 is coupled to the fan cover 50 in a vertical slide fashion. Each groove 55 has a vertical length greater than a lateral length. The opening and closing cover 70 is provided at the rear thereof with a plurality of hooks 71 corresponding to the grooves 55 of the fan cover 50.

Consequently, the hooks 71 of the opening and closing cover 70 are inserted in the corresponding grooves 55 of the fan cover 50, such that the vertical movement of the hooks 71 is guided by the grooves 55, whereby the vertical slide of the opening and closing cover 70 is possible.

The opening and closing cover 70 covers approximately the lower part of the fan cover 50. The opening and closing cover 70 has ventilation holes 73 and 75 corresponding to the lower ventilation holes 52*b* and 54*b* of the fan cover 50.

The ventilation holes 73 and 75 include inlet holes 73 formed at the front 72 of the opening and closing cover 70, such that the inlet holes 73 correspond to the lower inlet holes 52*b* of the fan cover 50, and outlet holes 75 formed at the edge 74 of the opening and closing cover 70, such that the outlet holes 75 correspond to the lower outlet holes 54*b* of the fan cover 50.

Figure 4:
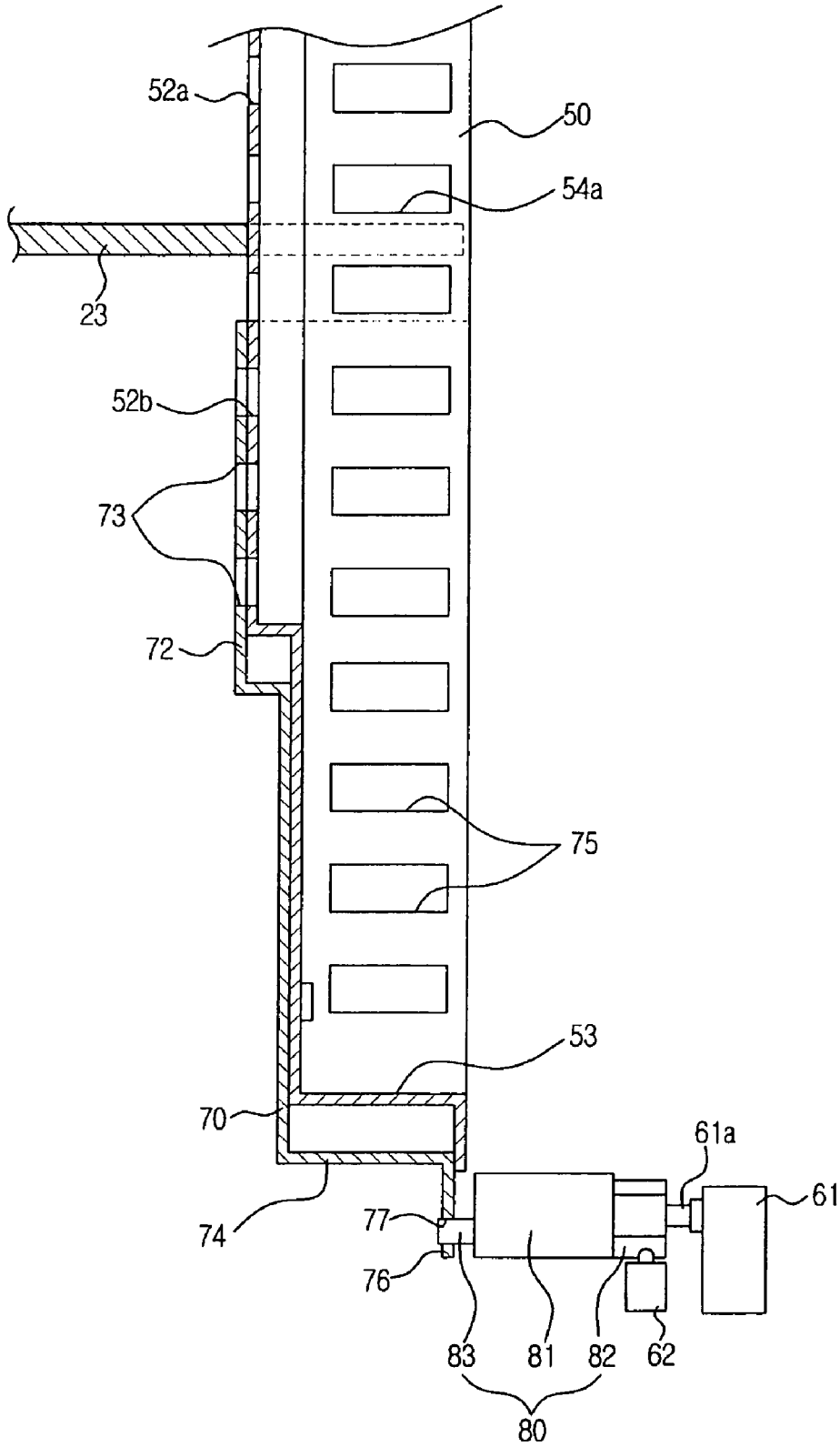
FIGS. 4 to 6 are views illustrating the operation of the heated air supply unit and the airflow adjusting unit of the cooking apparatus according to embodiments of the present invention.
Figure 5:
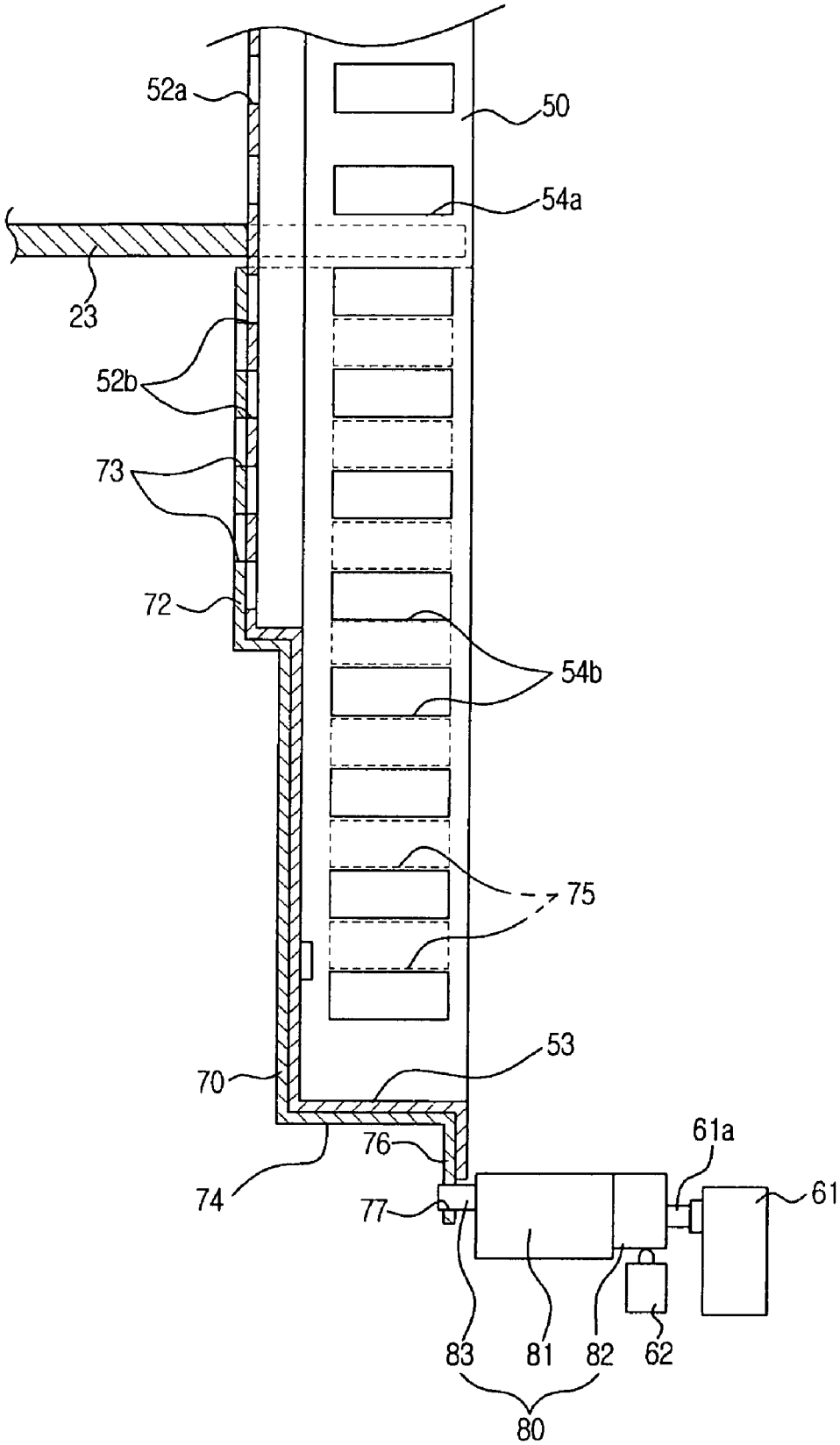

When the opening and closing cover 70 is vertically movably coupled to the fan cover 50, and, as shown in FIG. 4, the ventilation holes 73 and 75 of the opening and closing cover 70 are aligned with the lower ventilation holes 52*b* and 54*b* of the fan cover 50, the lower ventilation holes 52*b* and 54*b* of the fan cover 50 are completely opened. On the other hand, when the ventilation holes 73 and 75 of the opening and closing cover 70 are fully deviated from the lower ventilation holes 52*b* and 54*b* of the fan cover 50, as shown in FIG. 5, the lower ventilation holes 52*b* and 54*b* of the fan cover 50 are completely closed by the opening and closing cover 70.

In this embodiment, the positions and spaced intervals of the ventilation holes 73 and 75 of the opening and closing cover 70 and the lower ventilation holes 52*b* and 54*b* of the fan cover 50 and the positions of the hooks 71 of the opening and closing cover 70 and the grooves 55 of the fan cover 50 are adjusted such that the lower ventilation holes 52*b* and 54*b* of the fan cover 50 are completely closed, when the opening and closing cover 70 is located at the maximum ascent height relative to the fan cover 50, and the lower ventilation holes 52*b* and 54*b* of the fan cover 50 are completely opened, when the opening and closing cover 70 is located at the maximum descent height relative to the fan cover 50.

On the other hand, it is also possible to construct the ventilation holes and the hooks of the opening and closing cover and the lower ventilation holes and the grooves of the fan cover such that the lower ventilation holes of the fan cover are completely opened, when the opening and closing cover is located at the maximum ascent height relative to the fan cover, and the lower ventilation holes of the fan cover are completely closed, when the opening and closing cover is located at the maximum descent height relative to the fan cover.

Figure 6:
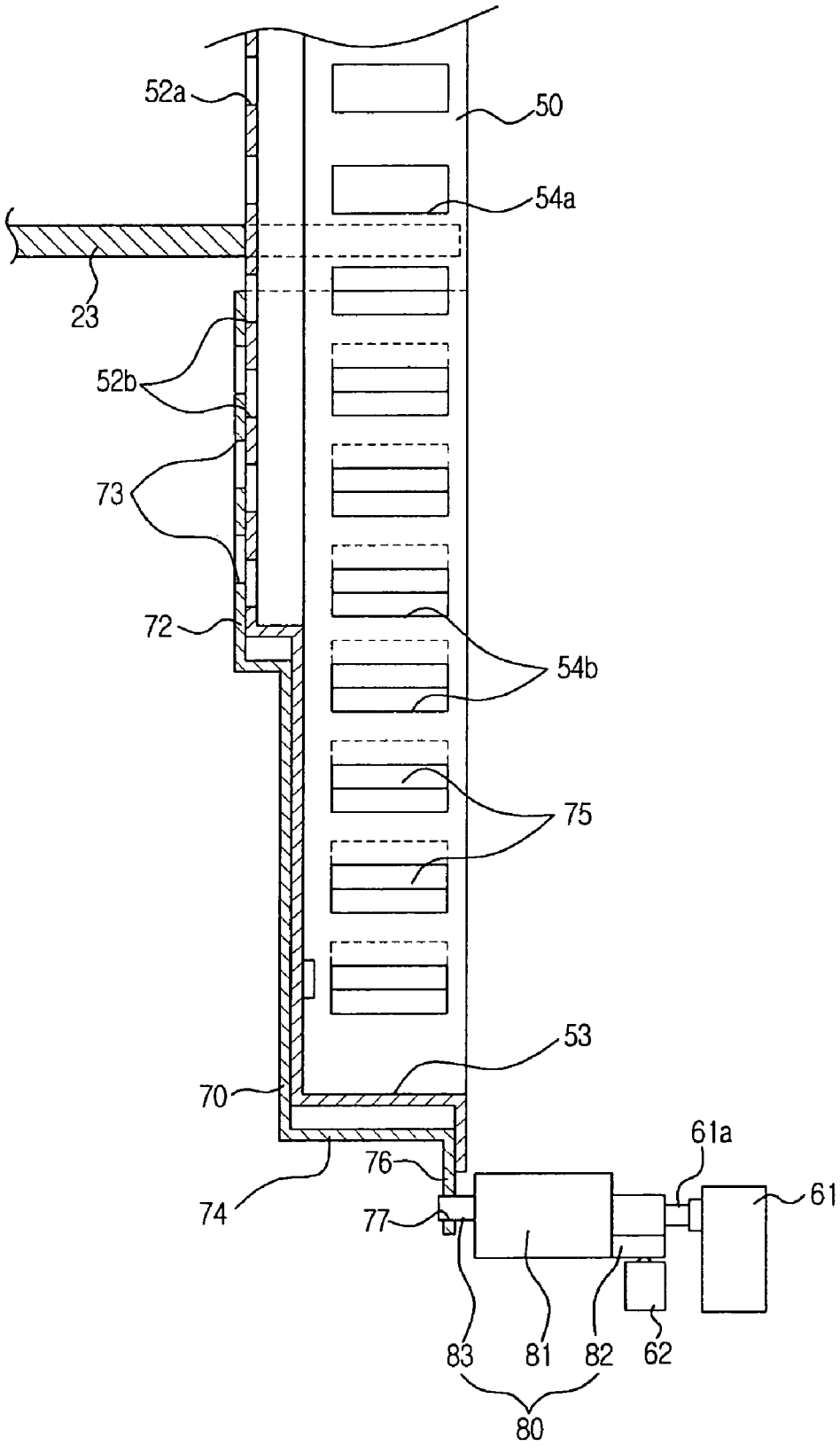

Also, it is possible to control the opening degree of the lower ventilation holes 52*b* and 54*b*, as shown in FIG. 6, by partially deviating the ventilation holes 73 and 75 of the opening and closing cover 70 from the lower ventilation holes 52*b* and 54*b* of the fan cover 50 through the adjustment of the vertical movement distance of the opening and closing cover 70. According to an embodiment of the present invention, when the opening and closing cover 70 moves upward, the opening degree of the lower ventilation holes 52*b* and 54*b* of the fan cover 50 is gradually decreased.

As shown in FIGS. 2 and 3, the opening and closing cover 70 is provided at the lower edge 74 thereof with an interlocking part 76 to convert the rotation of the drive motor 61 into the vertical linear movement of the opening and closing cover 70 such that the opening and closing cover 70 is vertically moved when the drive motor 61 is driven. The interlocking part 76 extends downward from the opening and closing cover 70.

The interlocking part 76 has a rectangular groove 77 having a lateral length greater than a vertical length. In the rectangular groove 77 is inserted an eccentric shaft 83 of the connection member 80, which will be described below. When the eccentric shaft 83 performs a circular movement by the drive motor 1, the eccentric shaft 83 slides laterally in the rectangular groove 77, and, at the same time, makes the interlocking part 76 to perform a linear reciprocating movement, thereby moving the opening and closing cover 70 vertically.

The rotation of the drive motor 61 is converted into the vertical movement of the opening and closing cover 70 through the cooperation of the drive motor 61, which performs a rotation, the connection member 80, which is coupled to the drive motor 61 and has the eccentric shaft 83, and the interlocking part 76, which extends from the opening and closing cover 70 such that the vertical movement of the opening and closing cover 70 is carried out by the rotation of the eccentric shaft 83, thereby adjusting the opening degree of the lower ventilation holes 52*b* and 54*b* of the fan cover 50.

The drive motor 61 provides a driving force necessary to rotate the connection member 80 such that the opening and closing cover 70 is vertically moved. The drive motor 61 is rotated in one direction at a specific rpm. The drive motor 61 may be fixedly mounted outside the rear 11*b* of the inner case 11 of the main body 10 corresponding to the installation position of the interlocking part 76 of the opening and closing cover 70.

The connection member 80 is disposed between a rotary shaft 61*a* of the drive motor 61 and the interlocking part 76 of the opening and closing cover 70 to convert the rotation of the drive motor 61 into the linear movement. The connection member 80 is coupled to the rotary shaft 61*a* of the drive motor 61, and therefore, the connection member 80 performs a rotation. The connection member 80 includes a body 81 disposed on the same axis as the rotary shaft 61*a* of the drive motor 61 to perform a rotation, a cam 82 formed at the rear of the body 81, and the eccentric shaft 83 protruding from the front of the body 81.

The body 81 protrudes into the inside of the rear 11*b* from the outside of the rear 11*b* of the inner case 11. At the rear 11*b* of the inner case 11 is formed an insertion groove 11*c*, through which the body 81 rotatably protrudes. The diameter of the insertion groove 11*c* and the diameter of the body 81 are appropriately adjusted to minimize the gap between the insertion groove 11*c* and the body 81 such that heated air is prevented from the cooking chamber 20 through the insertion groove 11*c*.

The cam 82, formed at the rear of the body 81, is rotated integrally with the body 81. With the rotation of the body 81, the cam 82 presses the switch 62 or releases the pressed state of the switch 62 to turn the switch 62 on/off.

The eccentric shaft 83 protrudes from the front of the body 81 such that the eccentric shaft 83 is inserted into the rectangular groove 77, formed at the interlocking part 76 of the opening and closing cover 70. The eccentric shaft 83 is rotated integrally with the body 81. With the rotation of the body 81, the eccentric shaft 83 performs a circular movement while the eccentric shaft 83 is spaced a predetermined distance from the center of the front of the body 81. The rotational diameter of the eccentric shaft 83 corresponds to the stroke distance of the vertical linear movement of the opening and closing cover 70.

When the drive motor 61 is driven, the connection member 80, axially coupled to the drive motor 61, rotates, with the result that the eccentric shaft 83, which protrudes from one end of the connection member 80, rotates and slides in the rectangular groove 77 of the interlocking part 76. Consequently, the opening and closing cover 70, which is formed integrally with the interlocking part 76, is vertically moved, by the rotation of the eccentric shaft 83, to open and close the lower ventilation holes 52*b* and 54*b* of the fan cover 50 or control the opening degree of the lower ventilation holes 52*b* and 54*b* of the fan cover 50.

Figure 7:
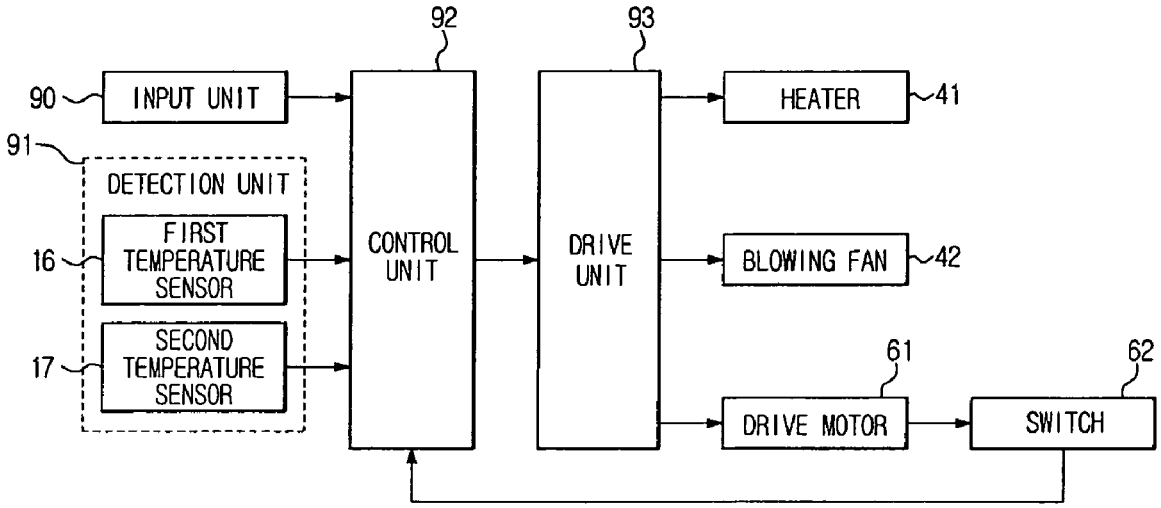
FIG. 7 is a control block diagram of the cooking apparatus according to an embodiment of the present invention.

FIG. 7 is a control block diagram of the cooking apparatus according to an embodiment of the present invention. The cooking apparatus includes an input unit 90, a detection unit 91, a control unit 92, a drive unit 93, a heater 41, a blowing fan 42, a drive motor 61, and a switch 62.

The input unit 12 allows a user to input a cooking start signal, set the temperature of the entire cooking chamber 20, when the divider 23 is not mounted in the cooking chamber 20, or set the respective temperatures of the first and second cooking chambers 21 and 22, divided by the divider 23. Generally, the input unit 12 is provided at the front of the main body 10 in the form of a button or a knob.

The input unit 12 may include temperature setting parts (not shown) to set the respective temperatures of the first and second cooking chambers 21 and 22. Alternatively, the input unit 12 may include a single temperature setting part to sequentially set the temperatures of the first and second cooking chambers 21 and 22.

The detection unit 91 detects the temperature of the cooking chamber 20. The detection unit 91 includes a first temperature sensor 16 mounted at the upper part of the cooking chamber 20 and a second temperature sensor 17 mounted at the lower part of the cooking chamber 20.

The control unit 92 is microprocessor to control the overall operation of the cooking apparatus based on a signal received from the input unit 90 and the detection unit 91. When the cooking apparatus is operated while the divider 23 is mounted in the cooking chamber 20, the control unit 92 determines whether the temperature of the first cooking chamber 21 has been inputted or the temperature of the second cooking chamber 22 has been inputted from the input unit 90.

When only the temperature of the first cooking chamber 21 is set, the control unit 92 controls the drive motor 61 to close the lower ventilation holes 52*b* and 54*b*, drives the blowing fan 42, and turns the heater 41 on/off, thereby controlling the temperature of the first cooking chamber 21. When the temperatures of both the first and second cooking chambers 21 and 22 are set, the control unit 92 drives the blowing fan 42 and turns the heater 41 on/off, thereby controlling the temperature of the first cooking chamber 21. In addition, the control unit 92 controls the drive motor 61 to adjust the opening degree of the lower ventilation holes 52*b* and 54*b*, thereby controlling the temperature of the second cooking chamber 22.

The drive unit 93 controls the blowing fan 42, the heater 41, and the drive motor 61 according to the signal from the control unit 92. With the rotation of the drive motor 61, the switch 62 is turned on/off. This signal is transmitted to the control unit 92, which controls the driving of the drive motor 61.

Figure 8:
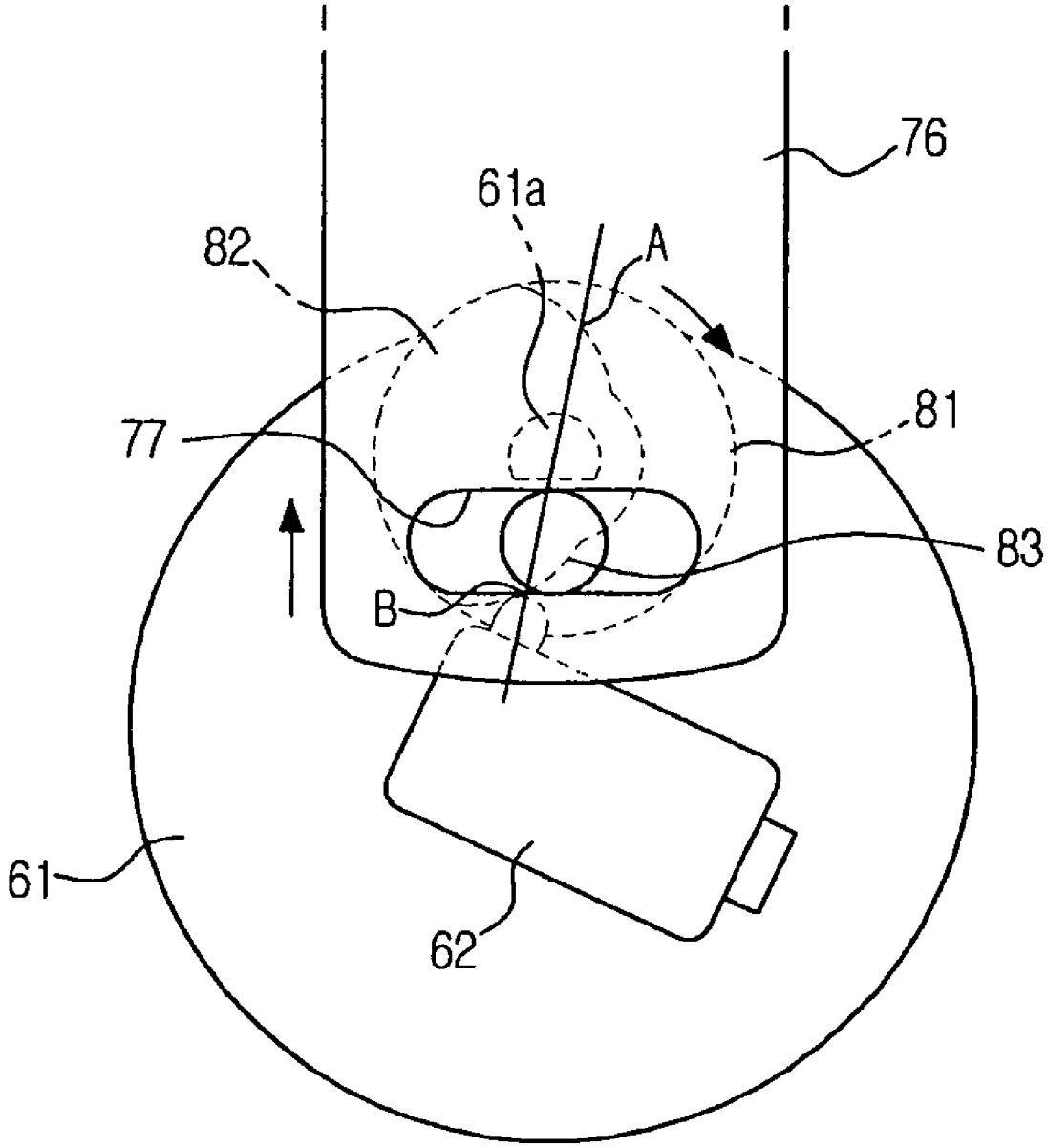
FIGS. 8 to 10 are views illustrating the operation of the airflow adjusting unit of the cooking apparatus according to embodiments of the present invention.

Hereinafter, a mechanism to control the opening degree of the lower ventilation holes of the fan cover by driving the airflow adjusting unit, when only the first cooking chamber is used and when both the first and second cooking chambers are used, will be described in more detail with reference to FIGS. 8 to 10.

When a user mounts the divider 23 in the cooking chamber 20 and begins to cook food, the control unit 92 determines whether only the first cooking chamber 21 is set to operate, or both the first and second cooking chambers 21 and 22 are set to operate, and drives the drive motor 61 through the drive unit 93 according to the setting.

At this time, the connection member 80, axially coupled to the drive motor 61, is rotated by the drive motor 61, the opening and closing cover 70 is vertically moved by the rotation of the eccentric shaft 83, formed at the connection member 80, and the switch 62 is turned on/off by the rotation of the cam 82. The signal generated by the on/off operation of the switch 62 is transmitted to the control unit 92. The position of the opening and closing cover 70 is detected according to the on/off signal of the switch 62, and therefore, the position of the opening and closing cover 70 is controlled.

Figure 9:
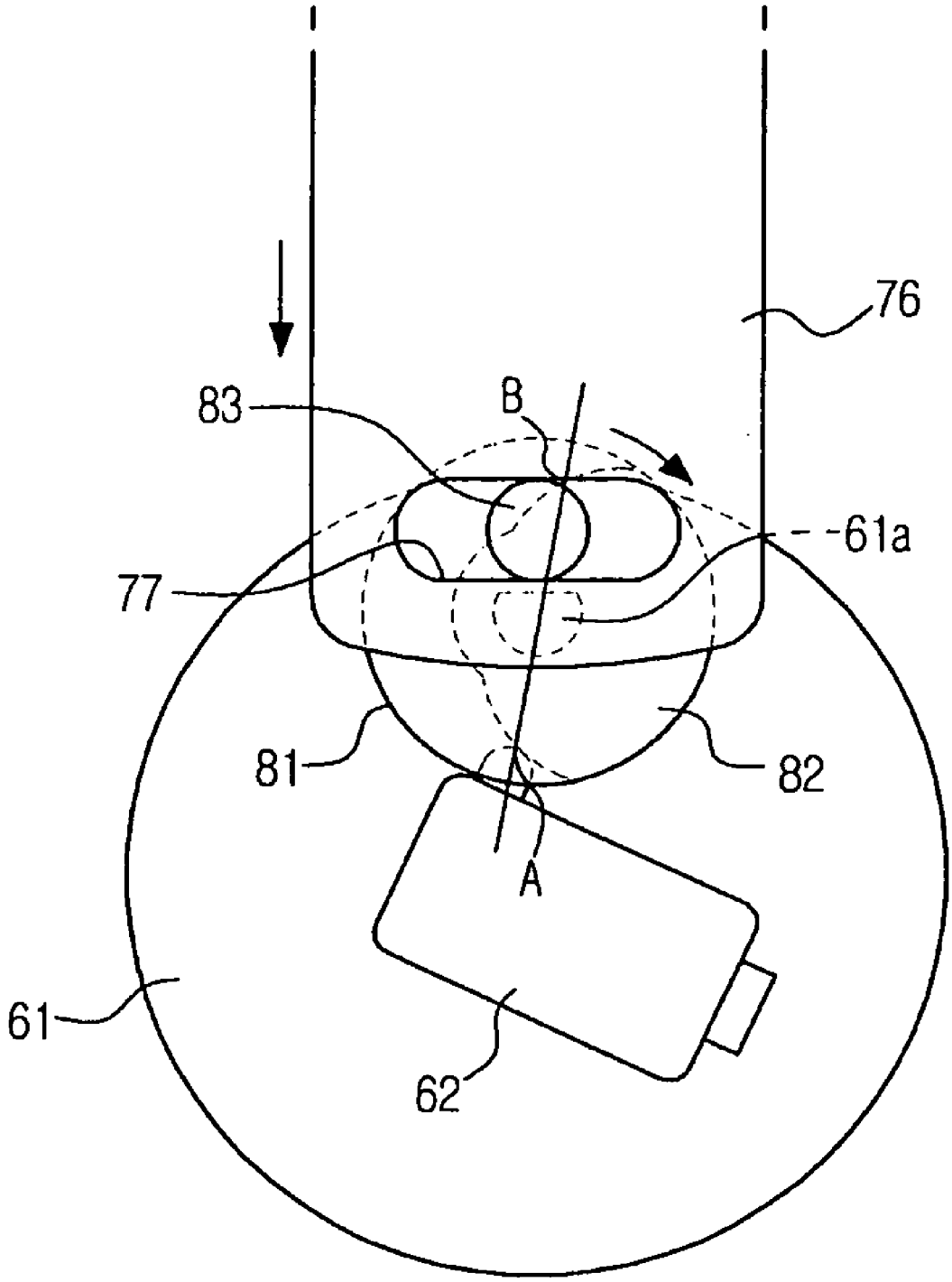
Figure 10:
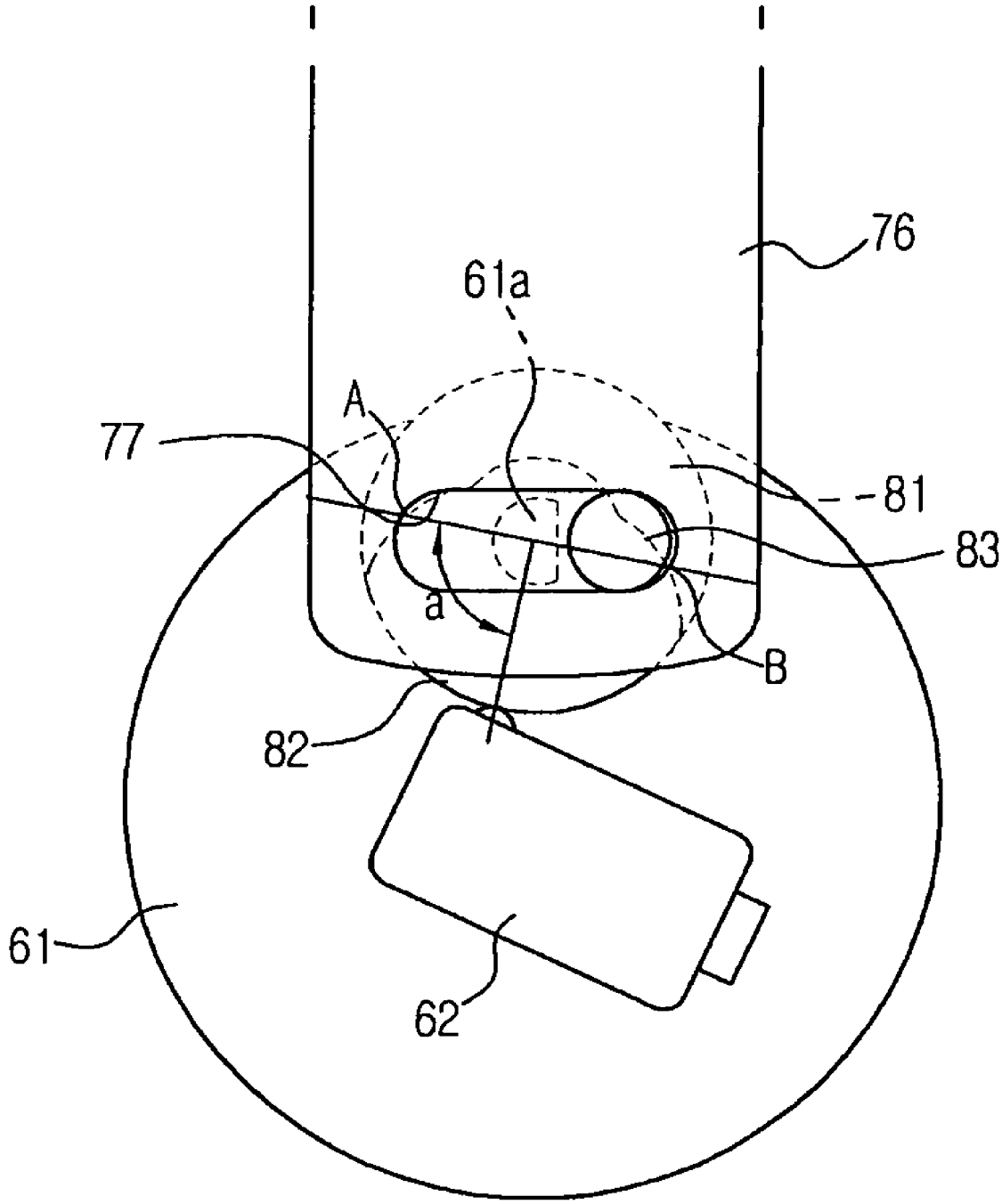

According to the present invention, the opening and closing cover 70 closes the lower ventilation holes 52*b* and 54*b* of the fan cover 50 at the point of time when the switch 62 is turned on (point A of FIG. 9). Now, the mechanism to control the opening degree of the lower ventilation holes based on the above-described construction will be described.

Of course, the structure of the connection member or the position of the switch may be changed such that lower ventilation holes of the fan cover are opened at the time when the switch is turned on by the initial driving of the drive motor.

First, when a user mounts the divider 23 and begins to cook food while only the temperature of the first cooking chamber 21 is set (i.e., when the second cooking chamber is not used), it is necessary for the control unit 92 to drive the drive motor 61 such that the second cooking chamber 22 is closed.

Consequently, the control unit 92 drives the drive motor 61 through the drive unit 93. When the cooking chamber is used while not being divided, as shown in FIG. 8, the opening and closing cover 70 is in a state in which the lower ventilation holes 52*b* and 54*b* of the fan cover 50 are maximally open (point B of FIG. 8). In this state, when the connection member 80 is rotated in the clockwise direction by the drive motor 61, the cam 82 is also rotated in the clockwise direction. When the cam 82 approaches a predetermined position A, the cam 82 presses the switch 62, and therefore, the switch 62 is turned on (see FIG. 9). As a result, the operation signal from the switch 62 is transmitted to the control unit 92, which determines that the lower ventilation holes 52*b* and 54*b* of the fan cover 50 have been closed based on the signal and terminates the operation of the drive motor 61. Consequently, the opening and closing cover 70 is maintained to close the lower ventilation holes 52*b* and 54*b* of the fan cover 50.

As described above, the cooking apparatus according to the present invention supplies heated air into the first cooking chamber 21 but interrupts the supply of heated air into the second cooking chamber 22. Consequently, only a part of the cooking chamber 20, i.e., the first cooking chamber 21, is heated to cook food. In this way, only the first cooking chamber 21 is used, when a small amount of food is to be cooked, whereby the cooking time is reduced and the energy efficiency is improved.

Next, the setting of the temperatures of both the first and second cooking chambers 21 and 22 to use the first and second cooking chambers 21 and 22 will be described. Here, it is not possible to set the temperature of the second cooking chamber such that the temperature of the second cooking chamber is higher than that of the first cooking chamber. In other words, it is necessary to cook food in the second cooking chamber at a lower temperature than in the first cooking chamber. This is due to the fact that the first and second cooking chambers are heated by the same heat source, and the amount of heated air supplied into the second cooking chamber is controlled by adjusting the opening degree of the lower ventilation holes, with the result that the temperature of the second cooking chamber is not higher than that of the first cooking chamber. Also, the cooking time of the second cooking chamber is set below the cooking time of the first cooking chamber.

When the cooking is initiated, the control unit 93 initially drives the drive motor 61. The position of the opening and closing cover 70 at the previous state is not known. Accordingly, the initial driving is a process to position the opening and closing cover 70 at the maximum height (complete closing of the lower ventilation holes) or at the minimum height (complete opening of the lower ventilation holes). According to the present invention, the lower ventilation holes are completely closed at the initial state.

Consequently, the control unit 92 drives the drive motor 61 to rotate the cam 82 such that the switch 62 is pressed. As a result, the switch 62 is turned on, and this signal is transmitted to the control unit 92, which performs the initial driving such that the opening and closing cover 70 is moved upward to close the lower ventilation holes 52*b* and 54*b* of the fan cover 50 (the state of FIG. 9).

After the initial driving is completed, the control unit 92 compares the temperatures of the first and second cooking chambers 21 and 22, set by the user, with data previous stored in the control unit 92, and drives the drive motor 61 such that the lower ventilation holes 52*b* and 54*b* are opened with the opening degree corresponding to the temperature difference ratio.

The appropriate opening amount is processed as data through the experiments on the opening amount of the lower ventilation holes 52*b* and 54*b* based on the set temperatures of the first and second cooking chambers 21 and 22 and the temperature difference ratio, and the data is previously stored in the control unit 92. When the difference in set temperature between the first and second cooking chambers 21 and 22 is greater than a predetermined amount, the control operation is performed such that the opening degree of the lower ventilation holes 52*b* and 54*b* is relatively reduced. When the difference in set temperature between the first and second cooking chambers 21 and 22 is less than or equal to the predetermined amount, the control operation is performed such that the opening degree of the lower ventilation holes 52*b* and 54*b* is relatively enlarged.

When the cooking apparatus is operated in a mode in which the opening degree of the lower ventilation holes 52*b* and 54*b* of the second cooking chamber is controlled at the initial heating stage, times necessary for the first and second cooking chambers 21 and 22 to reach the set temperatures become similar to each other. As a result, the temperature of the second cooking chamber 22, set at the relatively reduced temperature, slowly increases, and therefore, the cooking quality is improved.

Alternatively, the heating operation may be performed, while the lower ventilation holes 52*b* and 54*b* are completely open, during the initial heating, and, when the temperature of the second cooking chamber reaches the target temperature, the lower ventilation holes 52*b* and 54*b* may be completed closed and opened in an alternating fashion. Also, when the temperature of the second cooking chamber reaches the target temperature, the opening degree of the lower ventilation holes 52*b* and 54*b* may be controlled.

The opening amount of the lower ventilation holes 52*b* and 54*b* is controlled by the driving time of the drive motor 61. As shown in FIG. 10, the rotation angle a of the eccentric shaft 83 corresponding to the opening degree of the lower ventilation holes 52*b* and 54*b* is calculated, the driving time of the drive motor 61 having a predetermined rpm corresponding to the rotation angle a of the eccentric shaft 83 is calculated, and the drive motor 61 is driven for the calculated driving time, to set a desired opening degree of the lower ventilation holes 52*b* and 54*b*.

For example, when the opening degree of the lower ventilation holes 52*b* and 54*b* is set to ½ the maximum opening degree, the drive motor 61 is rotated such that the cam 82 turns the switch 62 on (the state of FIG. 9), the driving time of the drive motor 61 having a predetermined rpm is calculated such that the drive motor 61 is driven by the by the rotation angle (90 degrees) of the drive motor 61 corresponding to the opening degree of the lower ventilation holes 52*b* and 54*b*, and the drive motor 61 is driven for the calculated driving time, to control the opening degree of the lower ventilation holes 52*b* and 54*b*.

As described above, the relations between the driving time and rotation angle of the drive motor 61 and the opening degree of the lower ventilation holes 52*b* and 54*b* are previously stored in the control unit 92, and the control unit 92 controls the driving time of the drive motor 61 corresponding to the desired opening degree or rotation angle of the lower ventilation holes 52*b* and 54*b*. Here, the relation between the rotation angle of the drive motor 61 and the opening degree of the lower ventilation holes 52*b* and 54*b* is based on the condition that the initial state is the completely closes state (the state of FIG. 9).

Heated air is supplied into the second cooking chamber 22, while the opening degree of the lower ventilation holes 52*b* and 54*b* when the cooking is initiated is maintained. After the temperature of the second cooking chamber 22 reaches the set temperature due to the heated air supplied into the second cooking chamber 22, the opening degree of the lower ventilation holes 52*b* and 54*b* is increased or decreased based on the comparison between the detected temperature of the second cooking chamber 22 and the set temperature of the second cooking chamber 22.

Specifically, when the detected temperature of the second cooking chamber 22 is higher than the set temperature, the opening degree of the lower ventilation holes 52*b* and 54*b* is decreased, and, when the detected temperature of the second cooking chamber 22 is lower than the set temperature, the opening degree of the lower ventilation holes 52*b* and 54*b* is increased. Generally, the increase and decrease rates of the opening degree of the lower ventilation holes 52*b* and 54*b* are reduced such that the deviation of the cooking temperature of the second cooking chamber is reduced.

According to one embodiment of the present invention, the drive motor 61 rotates in one direction, e.g., in the clockwise direction. When it is necessary to increase the opening degree of the lower ventilation holes 52*b* and 54*b*, the driving time of the drive motor 61 corresponding to the opening amount to be increased is calculated, and the drive motor 61 is driven for the calculated time, thereby increasing the opening degree of the lower ventilation holes 52*b* and 54*b*.

When it is necessary to decrease the opening degree of the lower ventilation holes 52*b* and 54*b*, the drive motor 61 is driven to the initial state corresponding to the point of time when the cam 82 turns the switch 62 on (point A of FIG. 9), the rotation angle and driving time of the drive motor 61 corresponding to the desired opening degree is calculated, and the drive motor 61 is driven, thereby decreasing the opening degree of the lower ventilation holes 52*b* and 54*b*. When the drive motor 61 rotates in forward and reverse directions, on the other hand, the driving time of the drive motor 61 corresponding to the opening amount to be decreased is calculated, and the drive motor 61 is reversely rotated for the calculated time, thereby decreasing the opening degree of the lower ventilation holes 52*b* and 54*b*, in the same manner as the increase of the opening degree.

In the above description, the lower ventilation holes 52*b* and 54*b* are completely closed at the initial state. However, the lower ventilation holes 52*b* and 54*b* may be completely open at the initial state.

Also, the airflow adjusting unit may be constructed using a mechanism that converts a rotation into a linear movement, such as a rack and pinion or a cam.

In the above description, the motor rotates in one direction and has a predetermined rpm at a specific rpm. However, a motor that rotates in forward and reverse directions may be used, or a step motor that rotates at predetermines angle may be also used. When the step motor is used, the opening position and opening amount of the lower ventilation holes can be directly controlled. Consequently, the cam 82 or the switch 62 is not necessary, and therefore, the structure is simplified.

Figure 11:
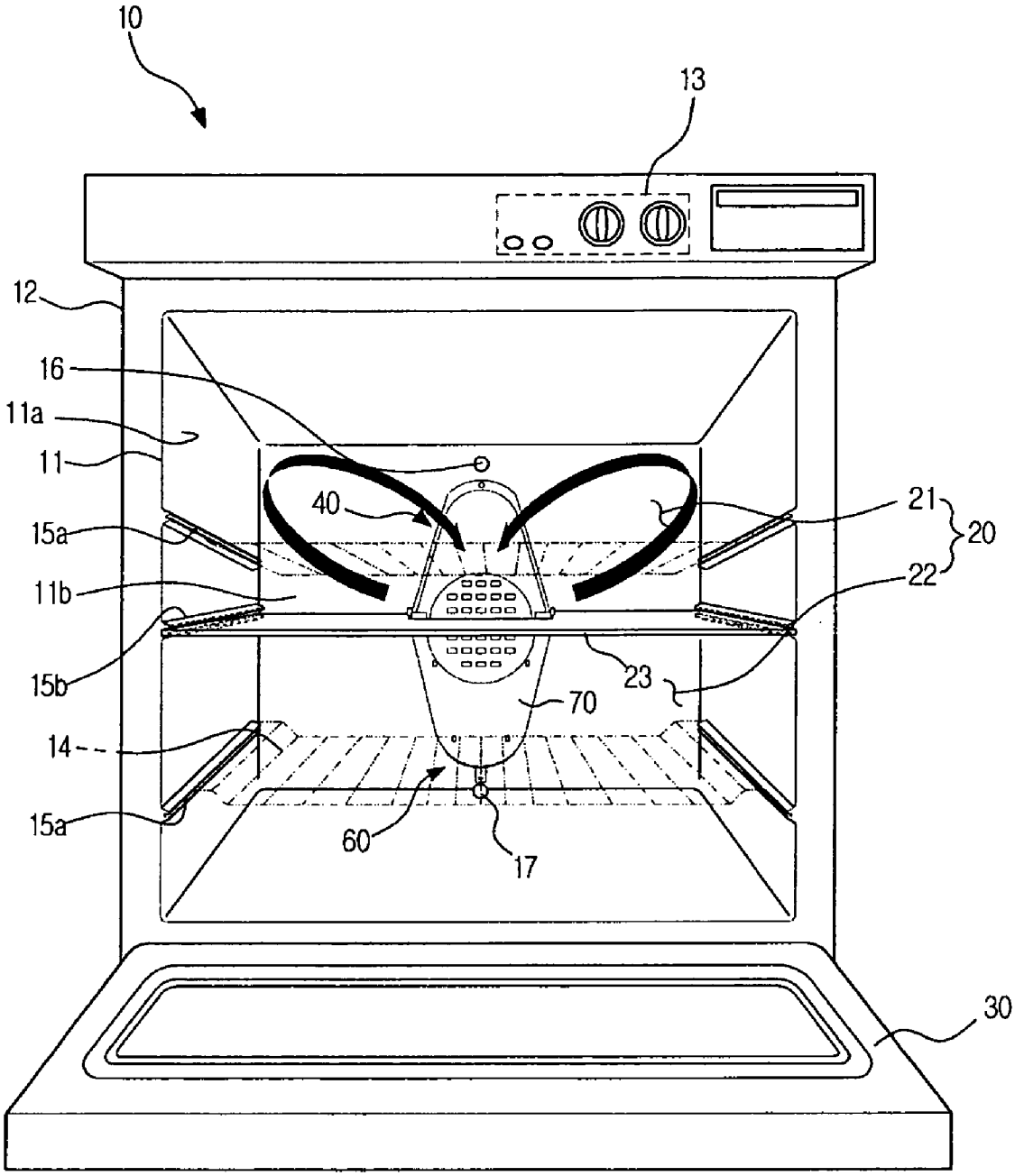
FIG. 11 is a view illustrating the circulation of air in a cooking chamber when the temperature of a first cooking chamber according to an embodiment of the present invention is set.
Figure 12:
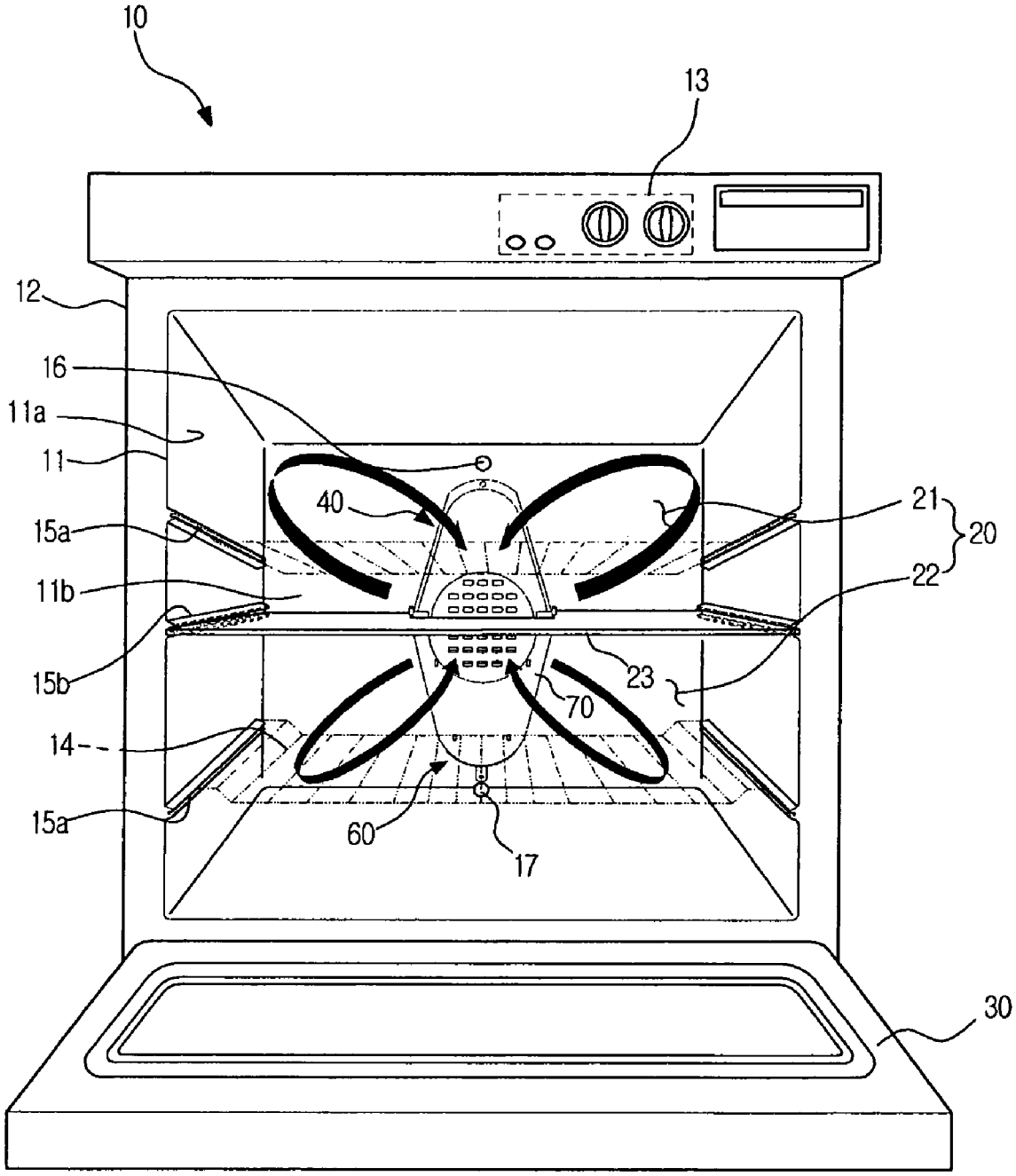
FIG. 12 is a view illustrating the circulation of air in the cooking chamber when the temperatures of first and second cooking chambers according to an embodiment of the present invention are set.

FIG. 11 is a view illustrating the circulation of air in the cooking chamber when the temperature of the first cooking chamber according to an embodiment of the present invention is set, and FIG. 12 is a view illustrating the circulation of air in the cooking chamber when the temperatures of the first and second cooking chambers according to an embodiment of the present invention are set.

When only the first cooking chamber is used, as shown in FIG. 11, the lower ventilation holes are completely closed. As a result, heated air is supplied only into the first cooking chamber 21, and the supply of heated air into the second cooking chamber 22 is interrupted. Consequently, only a part of the cooking chamber 20, i.e., the first cooking chamber 21, is heated to cook food. When both the first and second cooking chambers are used, as shown in FIG. 12, the opening degree of the lower ventilation holes 52*b* and 54*b* is increased without turning the heater or the blowing fan on/off. As a result, heated air, weaker than the heated air supplied into the first cooking chamber, is supplied into the second cooking chamber. Consequently, food is cooked in the first and second cooking chambers at different temperatures.

Figure 13:
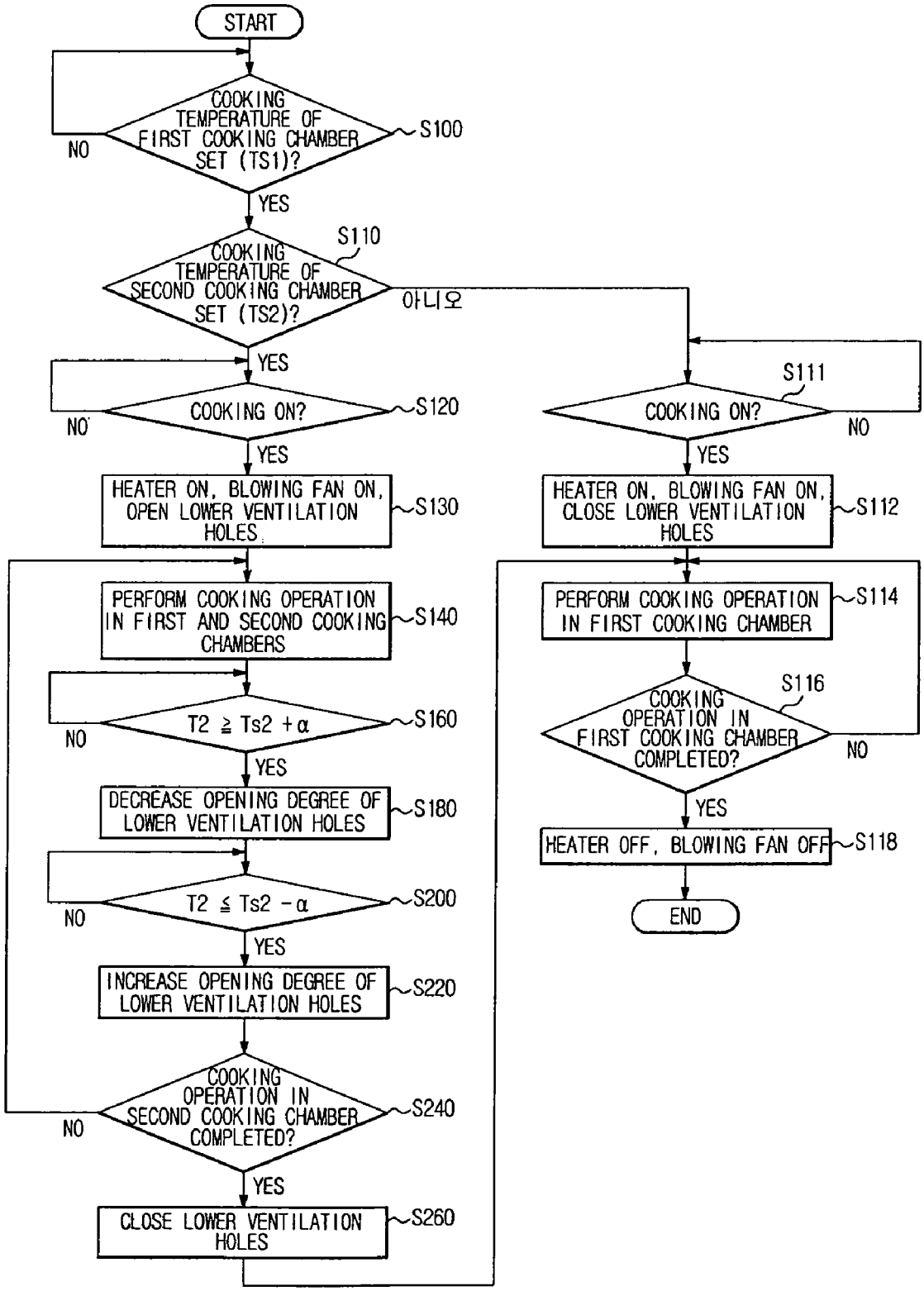
FIG. 13 is a flow chart illustrating a method of controlling the operation of the cooking apparatus according to an embodiment of the present invention.

Hereinafter, the control operation, when only the first cooking chamber is used while the divider is mounted in the cooking chamber and when both the first and second cooking chambers are used, will be described with reference to FIG. 13.

First, a user determines whether only the target temperature Ts1 of the first cooking chamber has been set or both the target temperature Ts1 of the first cooking chamber and the target temperature Ts2 of the second cooking chamber have been set (S100 and S110). As previously described, the target temperature of the second cooking chamber is set below the target temperature of the first cooking chamber. In the same manner, the cooking time of the second cooking chamber is set below the cooking time of the first cooking chamber.

When only the temperature of the first cooking chamber has been set but the temperature of the second cooking chamber has not been set, the procedure advances to S111 where it is determined whether a cooking start signal has been inputted. When it is determined that the cooking start signal has been inputted, the heater and the blowing fan are operated, the airflow adjusting unit is controlled to close the lower ventilation holes 52*b* and 54*b* (S112), and cooking in the first cooking chamber is carried out (S114). Here, the temperature of the first cooking chamber is controlled in a conventional method, i.e., by the on/off operation of the heater or the on/off operation of the blowing fan. Subsequently, it is determined whether the cooking has been completed (S116). When it is determined that the cooking has been completed, the heater and the blowing fan are turned off (S118), and the cooking process is ended.

When both the temperatures of the first and second cooking chambers have been set, the procedure advances to S120 where it is determined whether a cooking start signal has been inputted. When it is determined that the cooking start signal has been inputted, the procedure advances to S130 where the heater and the blowing fan are turned on and the lower ventilation holes are controlled to be opened at a predetermined opening degree. Here, the opening amount of the lower ventilation holes may be appropriately set in consideration of the ratio of the target temperature of the first cooking chamber and the target temperature of the second cooking chamber based on the previously stored data as previously described. Alternatively, the opening amount of the lower ventilation holes may be controlled based on the calculation of the rotation angle and driving time of the drive motor.

On the other hand, it is also possible that the heating is carried out, while the lower ventilation holes are not controlled to the predetermined opening degree at the beginning of the operation at S130 but the lower ventilation holes are completely opened, and, when the temperature of the second cooking chamber reaches the target temperature, the opening degree of the lower ventilation holes is controlled, or the lower ventilation holes are completely opened and closed in an alternating fashion.

Subsequently, the cooking in the first and second cooking chambers is carried out (S140). At this time, the temperature of the first cooking chamber is controlled by the on/off operation of the heater or the on/off operation of the blowing fan, as previously described. For the second cooking chamber, the temperature of the second cooking chamber is detected and it is determined whether the temperature of the second cooking chamber T2 is higher than the target temperature Ts2+α (S160). When it is determined that the temperature of the second cooking chamber T2 is higher than the target temperature Ts2+α, the opening degree of the lower ventilation holes is decreased (S180). Subsequently, it is determined whether the temperature of the second cooking chamber T2 is lower than the target temperature Ts2−α (S200). When it is determined that the temperature of the second cooking chamber T2 is lower than the target temperature Ts2−α, the opening degree of the lower ventilation holes is increased (S220). Here, the a value is appropriately designed in consideration of the durability of the airflow adjusting unit and the temperature change range of the second cooking chamber. Subsequently, it is determined whether the cooking in the second cooking chamber has been completed (S240). When it is determined that the cooking in the second cooking chamber is still being carried out, the procedure returns to S140. When it is determined that the cooking in the second cooking chamber has been completed, the lower ventilation holes are closed (S260), and the procedure advances to the process for controlling the first cooking chamber (S114) where the operation of the first cooking chamber is controlled.

The technical concept of the present invention is not limited to the above-described construction and control method but may be realized in different manners through the ordinary modification of the present invention made by those skilled in the art to which the present invention pertains. For example, the technical concept of the present invention may be realized by modifying the fan cover, the opening and closing cover, and the divider, even when the heated air supply unit and the airflow adjusting unit are mounted to the side of the cooking chamber, although the heated air supply unit and the airflow adjusting unit are mounted at the rear of the cooking chamber in the above description. Also, it is possible to control the temperature of the upper cooking chamber by adjusting the opening degree of the upper ventilation holes instead of the lower ventilation holes.

According to the cooking apparatus and method of controlling the same, as apparent from the above description, it is possible to cook food using only one of the cooking spaces divided by the divider while using the same heat source.

Also, it is possible to control the cooking spaces divided by the divider at different temperatures, while using the same heat source, through the relatively simple mechanical structure.

Furthermore, it is possible to reduce the temperature change in the cooking chamber by controlling the opening degree of the ventilation holes, through which heated air is introduced into or discharged from the cooking chamber, instead of controlling the temperature of the cooking chamber through the repetitive on/off operation of the heater or the blowing fan.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus comprising:

a cooking chamber;

a heated air supply unit to supply heated air into the cooking chamber, the heated air supply unit including a fan cover having ventilation holes;

a divider to divide the cooking chamber into cooking spaces; and an airflow adjusting unit to adjust the amount of heated air supplied to any one of the cooking spaces from the heated air supply unit, the airflow adjusting unit controlling the opening degree of the ventilation holes formed at the fan cover to adjust the amount of heated air supplied into the cooking space.

2. The cooking apparatus according to claim 1, wherein the airflow adjusting unit includes an opening and closing cover having ventilation holes corresponding to the ventilation holes of the fan cover, the opening and closing cover being vertically movably mounted at the front of the fan cover, a drive motor to provide a driving force necessary to vertically move the opening and closing cover, and a connection member to transmit the driving force from the drive motor to the opening and closing cover.

3. The cooking apparatus according to claim 2, wherein the connection member includes a body coupled to a rotary shaft of the drive motor on the same axis and an eccentric shaft protruding from the front of the body, and the opening and closing cover is provided at the lower end thereof with an interlocking part having a rectangular groove, in which the eccentric shaft of the connection member is fitted.

4. The cooking apparatus according to claim 3, wherein the drive motor is a motor that rotates in one direction or a motor that rotates in forward and reverse directions, the airflow adjusting unit further includes a switch that is turned on/off to detect the maximum height or the minimum height of the opening and closing cover, and the connection member is provided at the rear of the body thereof with a cam to turn the switch on/off with the rotation of the drive motor.

5. The cooking apparatus according to claim 3, wherein the drive motor is a step motor.

6. The cooking apparatus according to claim 2, wherein the opening and closing cover is provided at the rear thereof with hooks, and the fan cover has grooves to receive the hooks.

7. The cooking apparatus according to claim 2, wherein the fan cover and the opening and closing cover protrude from the rear of the cooking chamber, and the ventilation holes include inlet holes formed at the central front of the fan cover and outlet holes formed at the edge of the fan cover.

8. The cooking apparatus according to claim 7, wherein the divider has an insertion groove to surround the fan cover and the opening and closing cover.

9. A cooking apparatus comprising:

a cooking chamber;

a divider to divide the cooking chamber into cooking spaces;

a heated air supply unit including a fan cover having upper and lower ventilation holes;

a detection unit including temperature sensors to detect the interior temperatures of the cooking spaces;

an airflow adjusting unit to adjust the amount of heated air supplied to any one of the cooking spaces from the heated air supply unit; and a control unit to control the amount of heated air supplied into the cooking space through the airflow adjusting unit, based on the interior temperature of the cooking space detected by the detection unit, such that the detected temperature coincides with the target temperature set by a user, the airflow adjusting unit controlling the opening degree of the upper ventilation holes or the lower ventilation holes formed at the fan cover to adjust the amount of heated air supplied into the cooking space.

10. The cooking apparatus according to claim 9, wherein, when the target temperature of any one of the cooking spaces is not set by the user, the control unit controls the airflow adjusting unit to close the ventilation holes, through which heated air is supplied into the cooking space.

11. A method of controlling a cooking apparatus comprising first and second cooking chambers divided by a divider, a heated air supply unit including a fan cover having ventilation holes, and an airflow adjusting unit to adjust the amount of heated air supplied into the second cooking chamber, the method comprising:

determining whether target temperatures of the first and second cooking chambers have been set;

when it is determined that the target temperatures of the first and second cooking chambers have been set, operating the heated air supply unit and the airflow adjusting unit to control the opening degree of the ventilation holes communicating with the second cooking chamber such that the temperature of the second cooking chamber coincides with the target temperature of the second cooking chamber; and performing a cooking operation in the first and second cooking chambers.

12. The method according to claim 11, further comprising:

determining whether the temperature of the second cooking chamber has reached the target temperature;

when the temperature of the second cooking chamber is higher by a predetermined level than the target temperature, controlling the airflow adjusting unit to decrease the opening degree of the ventilation holes communicating with the second cooking chamber; and when the temperature of the second cooking chamber is lower by the predetermined level than the target temperature, controlling the airflow adjusting unit to increase the opening degree of the ventilation holes communicating with the second cooking chamber.

13. The method according to claim 12, further comprising:

determining whether the cooking operation in the second cooking chamber has been completed, and, when the cooking operation has been completed, controlling the airflow adjusting unit to close the ventilation holes communicating with the second cooking chamber and continuously performing the cooking operation in the first cooking chamber.

14. The method according to claim 11, further comprising:

when only the target temperature of the first cooking chamber is set, operating the heated air supply unit and the airflow adjusting unit to close the ventilation holes communicating with the second cooking chamber; and performing only the cooking operation in the first cooking chamber.

15. A method of controlling a cooking apparatus comprising first and second cooking chambers divided by a divider, a heated air supply unit including a fan cover having ventilation holes, and an airflow adjusting unit to adjust the amount of heated air supplied into the second cooking chamber, the method comprising:

determining whether target temperatures of the first and second cooking chambers have been set;

when it is determined that the target temperatures of the first and second cooking chambers have been set, operating the heated air supply unit and the airflow adjusting unit to completely open the ventilation holes communicating with the second cooking chamber;

performing a cooking operation in the first and second cooking chambers; and when the temperature of the second cooking chamber has reached the target temperature, operating the airflow adjusting unit to control the opening degree of the ventilation holes communicating with the second cooking chamber.

16. The method according to claim 15, further comprising:

determining whether the cooking operation in the second cooking chamber has been completed, and, when the cooking operation has been completed, controlling the airflow adjusting unit to close the ventilation holes communicating with the second cooking chamber and continuously performing the cooking operation in the first cooking chamber.

17. The cooking apparatus according to claim 2, further including a blowing fan, a heater and a control unit to drive the drive motor and the blowing fan and to turn the heater on/off.

18. The cooking apparatus according to claim 17, wherein the divider divides the cooking chamber into a first cooking chamber and a second cooking chamber and when only a temperature of the first cooking chamber is set, the control unit controls the drive motor to close a predetermined portion of the ventilation holes and turns the heater on/off to control the temperature of the first cooking chamber.

19. The cooking apparatus according to claim 17, wherein the divider divides the cooking chamber into a first cooking chamber and a second cooking chamber and when temperatures of both the first and second cooking chambers are set, the control unit drives the blowing fan and turns the heater on/off to control the temperature of the first cooking chamber, and controls the drive motor to adjust an opening degree of a predetermined portion of the ventilation holes to control the temperature of the second cooking chamber.

20. The cooking apparatus according to claim 17, wherein the divider divides the cooking chamber into a first cooking chamber and a second cooking chamber and the second cooking chamber is not in use, the control unit controls the drive motor to close off the second cooking chamber to limit the supply of heated air to the first cooking chamber.

* * * * *